US005975459A

United States Patent [19]

Roman

[11] Patent Number: 5,975,459

[45] Date of Patent: Nov. 2, 1999

[54] DRUM FOR HOSE REEL CARTS FOR WATERING

[75] Inventor: Gianfranco Roman, Pasiano, Italy

[73] Assignee: Claber S.p.A., Fiume Veneto, Italy

[21] Appl. No.: 09/109,183

[22] Filed: Jul. 2, 1998

[30] Foreign Application Priority Data

Jul. 7, 1997 [IT] Italy ..... MI97U0502

[51] Int. Cl.[6] ..... B65H 75/14; B65H 75/18

[52] U.S. Cl. ..... 242/608.6; 242/609.1

[58] Field of Search ..... 242/608.6, 609.1, 242/610.4, 610.6, 613; 137/355.26

[56] References Cited

U.S. PATENT DOCUMENTS 4,702,429 10/1987 Black ..... 242/71.8

FOREIGN PATENT DOCUMENTS 0243884 11/1987 European Pat. Off. .
9206906 7/1992 Germany .
9210081 9/1992 Germany .
1-98575 4/1989 Japan ..... 242/608.6

*Primary Examiner*—John Q. Nguyen
*Attorney, Agent, or Firm*—Jacobson, Price, Holman & Stern, PLLC

[57] ABSTRACT

A drum for hose reel carts for watering comprising a hub, a pair of flanges and a pair of covering discs for the coupling zones between the flanges and the hub. Said hub comprises a plurality of tubular elements provided with coupling elements and said covering discs are provided with projections that can be slidingly inserted in said tubular elements of the hub and snap lockable with them by means of complementary coupling devices, and additional coupling devices for the snap locking of said discs with said flanges. Said discs are provided with centring elements engageable with respective centring elements present on said flanges.

4 Claims, 3 Drawing Sheets

DRUM FOR HOSE REEL CARTS FOR WATERING

DESCRIPTION

The present invention concerns a drum for hose reel carts for watering.

BACKGROUND OF THE INVENTION

Hose reel carts for watering, that comprise a drum formed by a hub, on which a hose is wound, and by a pair of flanges, particularly circular, that have the function to retain the wound hose sideways, are already known.

The drum is turningly held by two side walls which bears also an axis for the cart wheels, a first tubular element that extends substantially parallel to the ground and that functions as resting base for the cart itself, and a second tubular element, that extends upward and forms the cart handle.

Some known carts show a certain construction complexity and difficulties in the assembly of the drum forming parts.

BRIEF SUMMARY OF THE INVENTION

Object of the present invention is to realise a drum for hose reel carts for watering, that would be simple to realise and easy to assemble.

According to the present invention, such object is attained by means of a drum for hose reel carts for watering comprising a hub, a pair of flanges and a pair of covering discs for the coupling zones between the flanges and the hub, characterised in that said hub comprises a plurality of tubular elements provided with coupling elements and said covering discs are provided with projections that can be slidingly inserted in said tubular elements of the hub and snap lockable with them by means of complementary coupling means, and additional coupling elements for the snap locking of said discs with said flanges.

Said discs are advantageously provided with centring elements engageable with corresponding centring elements present on said flanges.

BRIEF DESCRIPTION OF THE DRAWINGS

A possible embodiment is illustrated as a non-limiting example in the enclosed drawings, in which.

DETAILED DESCRIPTION OF THE INVENTION

Figure 1:
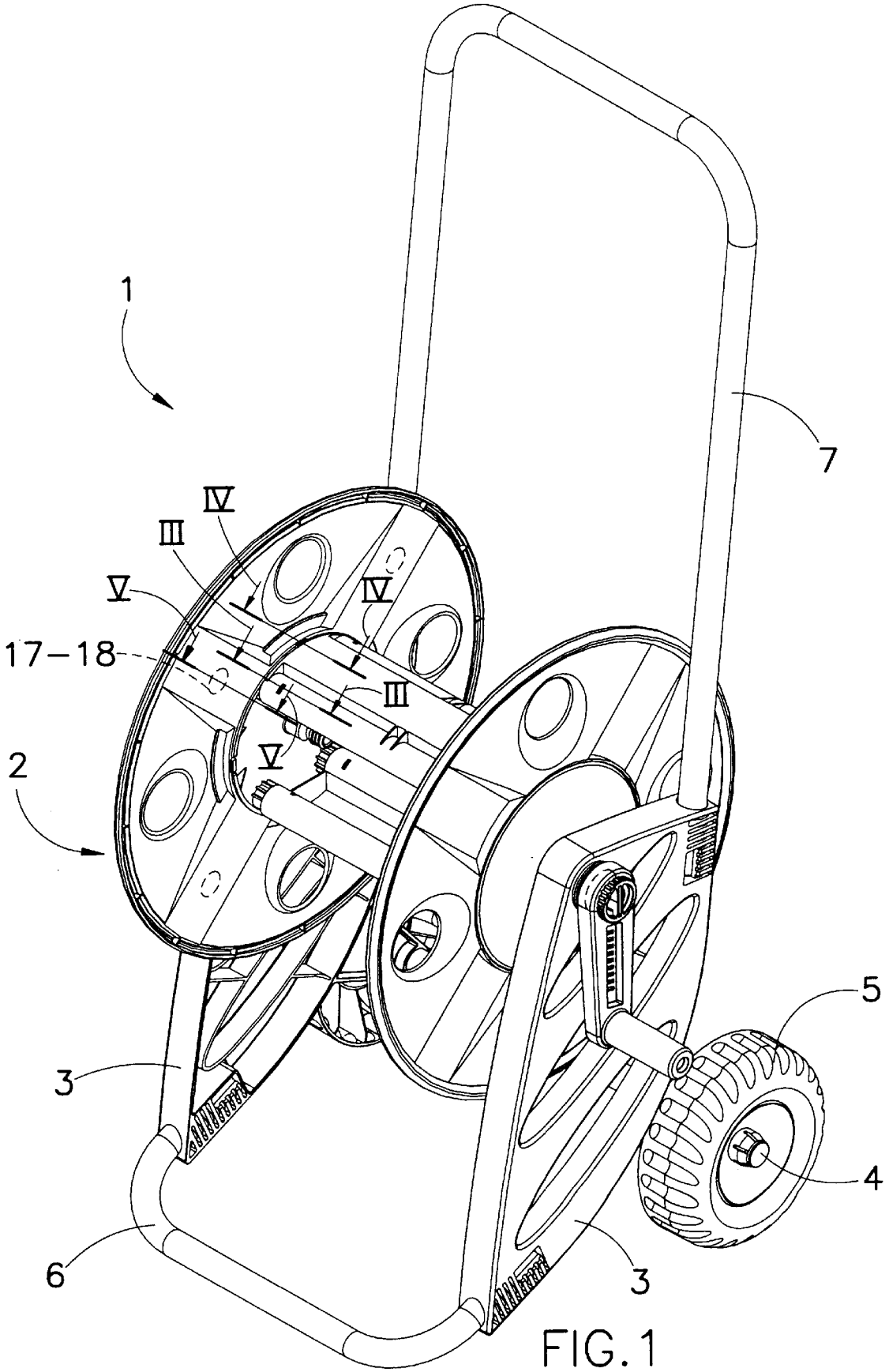
FIG. 1 is a perspective front view from the top of a hose reel cart provided with a drum according to the invention.

With reference to FIG. 1, a hose reel cart 1 for watering comprises a drum 2 held turningly by two side walls 3. Said side walls 3 also bear an axis 4 for wheels 5 for the movement of the cart 1, a first tubular element 6 that functions as resting base for the cart 1, and a second tubular element 7, that extends upward and forms the handle of the cart 1.

The drum 2 comprises a hub 8, on which a hose is wound, a pair of flanges 9, in particular of annular shape, that limit the hub 8 sideways and a pair of covering discs 10.

Figure 2:
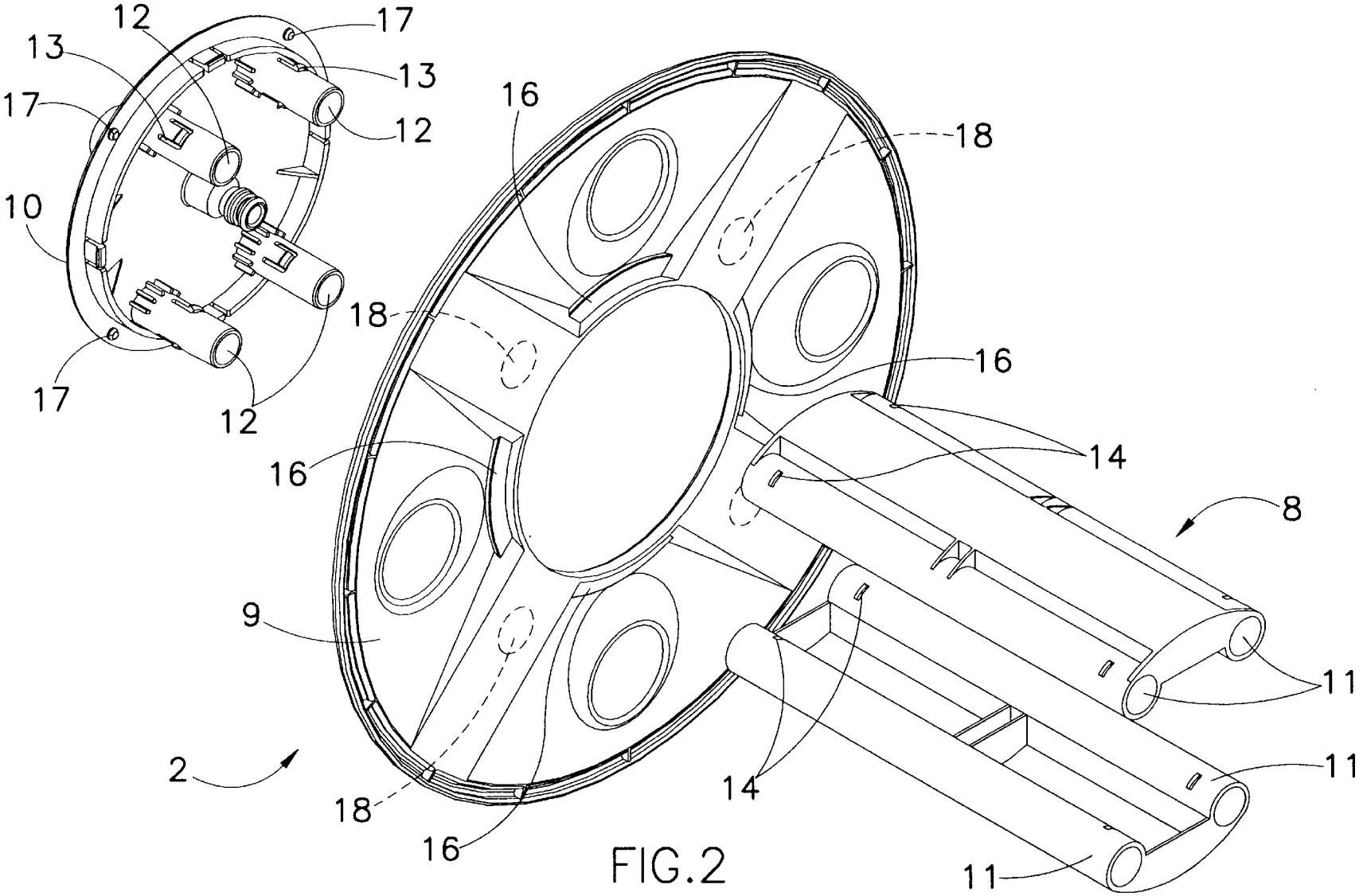
FIG. 2 is an exploded view of parts of the drum according to the invention.

As FIG. 2 shows, the hub 8 comprises tubular elements 11 rigidly coupled two by two.

Each covering disc 10 is provided, on one of its faces, with tubular projections 12, that can be slidingly inserted in the tubular elements 11 of the hub 8.

Such projections 12, that can possibly be equally spaced on the surface of the disc 10, in any case in a way conform to the tubular elements 11 of the hub 8, are provided with coupling elements 13 that are snap couplable with complementary coupling elements 14 present on the tubular elements 11.

Figure 3:
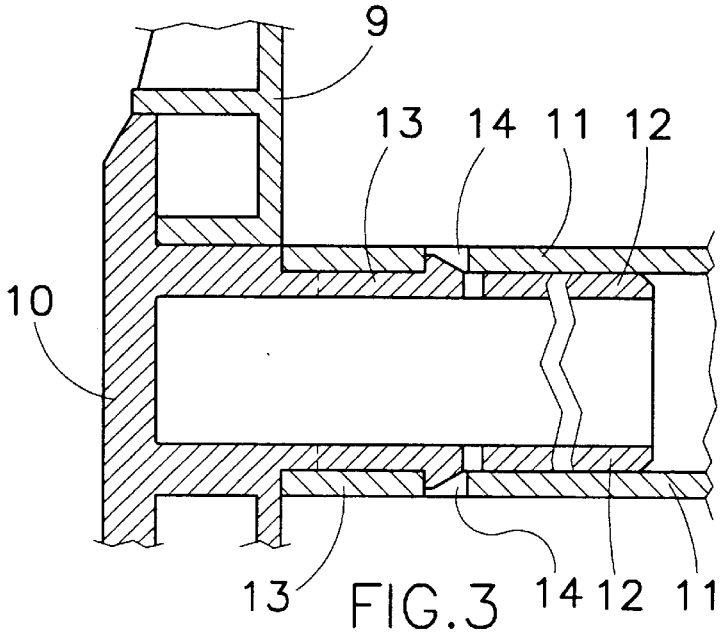
FIG. 3 is a sectional view of coupling elements of the drum according to the invention along line III—III of FIG. 1.

FIG. 3 shows a possible embodiment of said coupling elements 13, 14 comprising an elastic L-shape tang 13 with the smaller side shaped in such a way as to consent an easy engagement of the same in complementary housings 14.

The covering disc 10 is provided with other coupling elements 15 arranged in such a way as to couple with other complementary coupling elements 16 which the flanges 9 are provided with.

Figure 4:
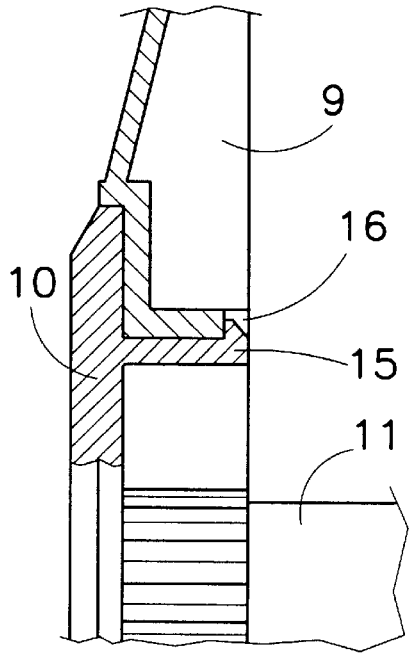
FIG. 4 is a sectional view of other coupling elements of the drum according to the invention along line IV—IV of FIG. 1.

As FIG. 4 shows, these coupling elements 15 too can by made by elastic L-shape tangs 15 that engage in respective openings 16 provided near the internal edge of the flange 9.

Figure 5:
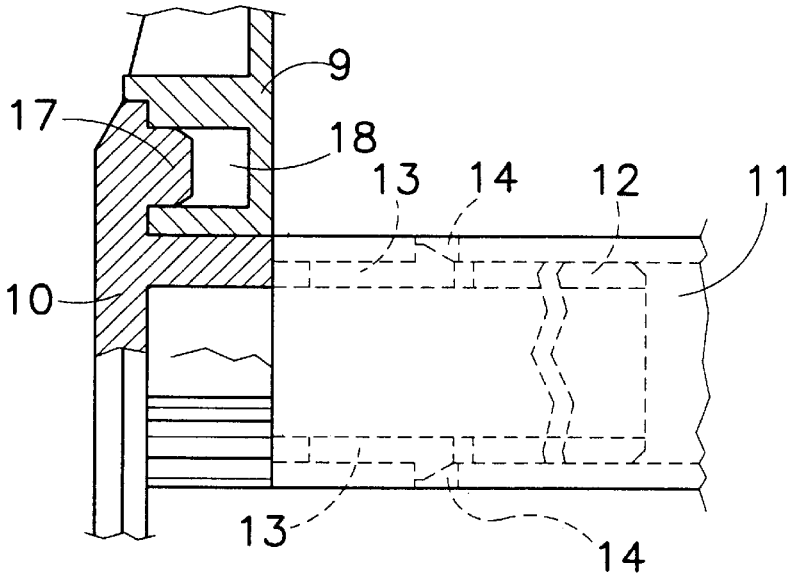
FIG. 5 is a sectional view of centring elements of the drum according to the invention along line V—V of FIG. 1.

In addition, the covering disc 10 is provided with centring elements 17, in particular projections, arranged in such a way so as to engage with cavities 18 which the flanges 9 are provided with (FIGS. 2 and 5).

During the stage of assembly of the drum 1, the projections 12 of the discs 10 are slidingly coupled with the tubular elements 11 of the hub 8 and the flanges 9 are interposed between the discs 10 and the hub 8.

After the insertion, at the limit stop, the elastic tangs 13 snap lock in the respective housings 14.

Simultaneously, the elastic tangs 15 snap lock in the openings 16 of the flanges 9. In this way the flanges 9 are fixed to the disc 10 and the sliding of the flanges 9 on the hub 8 is prevented.

In order to prevent the relative rotation of the flanges 9 with respect to the disc, during the assembly stage, the projections 17 are engaged in the relative cavities 18.

The drum according to the invention provides easy assembly and simple construction, enabling the assembly of the different parts of the drum by means of simple snap locking elements.

All the different parts of the drums can be advantageously made of plastic material, but some of them, in particular the flanges, can also be made of metal.

I claim:

1. Drum for hose reel carts for watering comprising a hub, a pair of flanges and a pair of covering discs for coupling zones between the flanges and the hub, characterised in that said hub comprises a plurality of tubular elements provided with coupling elements and said covering discs are provided with projections respectively inserted in said tubular elements of the hub and snap lockable with the coupling elements by means of complementary coupling means, and additional coupling means for the snap locking of said discs with said flanges.

2. Drum according to claim 1, characterised in that said discs are provided with centring elements engageable with corresponding centring elements present on said flanges.

3. Drum according to claim 2, characterised in that said centring elements of said discs consist of projections engageable in respective cavities forming said centring elements of said flanges.

4. Drum according to claim 1, characterised in that said projections comprise elastic tangs and said coupling elements comprise complementary coupling holes.

* * * * *